US007836899B2

(12) United States Patent
Sugai et al.

(10) Patent No.: US 7,836,899 B2
(45) Date of Patent: Nov. 23, 2010

(54) WIG AND METHOD OF MANUFACTURING THE SAME

(75) Inventors: Hiroko Sugai, Shinjuku-ku (JP); Takashi Sato, Shinjuku-ku (JP); Chisato Honma, Shinjuku-ku (JP); Yoshimi Sasaki, Shinjuku-ku (JP)

(73) Assignee: Aderans Holdings Co., Ltd. (JP)

( * ) Notice: Subject to any disclaimer, the term of this patent is extended or adjusted under 35 U.S.C. 154(b) by 484 days.

(21) Appl. No.: 11/813,022

(22) PCT Filed: Dec. 26, 2005

(86) PCT No.: PCT/JP2005/023741

§ 371 (c)(1),
(2), (4) Date: Jun. 28, 2007

(87) PCT Pub. No.: WO2006/070721

PCT Pub. Date: Jul. 6, 2006

(65) Prior Publication Data

US 2008/0092913 A1 Apr. 24, 2008

(30) Foreign Application Priority Data

Dec. 28, 2004 (JP) ..... 2004-380800

(51) Int. Cl.
*A41G 3/00* (2006.01)
*A41G 5/00* (2006.01)

(52) U.S. Cl. ..... 132/201

(58) Field of Classification Search ..... 132/53, 132/201, 54–56

See application file for complete search history.

(56) References Cited

U.S. PATENT DOCUMENTS

| | | | | |
|---|---|---|---|---|
| 1,490,466 | A | 4/1924 | Hapka | |
| 2,736,325 | A * | 2/1956 | Dvorzsak | 132/53 |
| 2,814,301 | A * | 11/1957 | Schmitz | 132/201 |
| 4,453,555 | A * | 6/1984 | Finamore | 132/53 |

FOREIGN PATENT DOCUMENTS

| | | |
|---|---|---|
| JP | 52-123755 A | 10/1977 |
| JP | 62-126322 A | 8/1987 |
| JP | 64-040605 A | 2/1989 |
| JP | 2-66632 A | 5/1990 |

(Continued)

OTHER PUBLICATIONS

International Search Report for PCT/JP2005/023741 for Examiner consideration, citing foreign references Nos. 1, 2, 6 and U.S. patent No. 1 listed above.

(Continued)

*Primary Examiner*—Robyn Doan
(74) *Attorney, Agent, or Firm*—Chen Yoshimura LLP

(57) ABSTRACT

In a wig 10 comprising a wig base 11 and hairs 12 tied thereon, the wig base 11 is made with a base member 14 of artificial skin and a second base member 15 made of a net member provided on its backside, hairs 12 are knotted to the second base member 15, and inserted and pulled out from the lower side of the first artificial skin base member 14 to the surface side, thereby a wig 10 is obtained in which a needle foot is not formed on the backside of a wig base, and which has such natural appearance as if the hair 12 grows from skin pores, and excels in appearance.

5 Claims, 9 Drawing Sheets

FOREIGN PATENT DOCUMENTS

| | | | |
|---|---|---|---|
| JP | 04-361604 | A | 12/1992 |
| JP | 07-229009 | A | 8/1995 |
| JP | 2001-089921 | A | 4/2001 |
| JP | 3484565 | B2 | 10/2003 |

OTHER PUBLICATIONS

PCT/ISA/237 in PCT/JP2005/023741 and its translation of Section V.

PCT/IPEA/409 in PCT/JP2005/023741, citing foreign references No. 1, 6, 7, and 8.

Applicants arguements filed in sibmitting Article 34 Amendments in PCT/JP2005/023741 and its English language translation.

PCT/IPEA/408 in PCT/JP2005/023741 and its translation of Section V, citing foreign references No. 1, 6, 7, and 8.

* cited by examiner (D)

(E)

(F)

WIG AND METHOD OF MANUFACTURING THE SAME

TECHNICAL FIELD

The present invention relates to a wig without a so-called needle foot formed upon attaching hair to a wig base, capable of preventing exposure of knots upon knotting hair to the wig base, especially making hairline looking natural, and giving such appearance as if the wearer's own hair grows from the scalp, and to a method of manufacturing the same.

BACKGROUND ART

A wig comprises in general a wig base and hair being either natural or artificial hair attached to the wig base.

FIG. 8 is a schematic sectional view illustrating an exemplary makeup of a conventional wig. In FIG. 8, a wig 50 comprises a base 52 made with thin artificial skin with such a soft synthetic resin as urethane resin as the material, the hairs 53 tied to the artificial skin base 52 and extending to its surface side, and a backside coating portion 54 formed on the backside of the artificial skin base 52. The artificial skin base 52 is transparent or semi-transparent in general, and formed soft and ultra thin of about 0.02 to 0.5 mm thickness, and when worn on a head, even if artificial skin is exposed through the hairs tied to the artificial skin base, it looks as if a real scalp.

As an example of tying hairs 53 to the artificial skin base 52, there is a case to knot and attach hairs to the surface side of the artificial skin base 52 (not shown in the figure). In this case, after penetrating a hooking needle from the surface side to the backside of the artificial skin base 52, the hook portion of the hooking needle is exposed to the surface side at a near position on the backside, followed by pulling out after hooking with said hooking needle a doubly bent hair to the backside, then the bent portion of the hair appears on the surface as a loop. A pair of free end sides of the hair are pulled through the loop and knotted to a surface of an artificial skin base 52 to form a knot. By repeating this work, hairs are tied at a predetermined density on a surface of an artificial skin base 52. However, in this case, since a boss-like knot is formed on the surface side of the artificial skin base 52, said boss-like knot is directly visible through hairs, thereby it is easily recognized as not the wearer's own hair.

Therefore, as another example of tying hair 53 to the artificial skin base 52 as shown in FIG. 9, an art so-called V-tying is often used in which hairs 53 are simply penetrated through the base 52. In case of V-tying, after a hooking needle is penetrated from the surface side, the hook portion is exposed at a near position from the backside to the surface side, and the doubly bent hair 53 is hooked with this hooking needle and pulled in to the backside, a needle foot 53*a* of the pre-determined length is formed, and only one side of the paired hair is pulled again to the surface side. Thereby, a paired hair is thereby tied in V or U shape from the surface of the artificial skin base. By the V-tying art, the central portion of a hair is formed linearly to about 0.5 to 2 mm on the backside of the artificial skin base (called a needle foot), but the hair can be relatively unrecognizable as not the wearer's own hair, since a knot is not formed on the surface of artificial skin base.

However, as shown in FIG. 9, a hair 53 is inserted from the surface side of an artificial skin base 52 at a first position 52*a* to penetrate to the backside, pulled out to the surface side at a second position 52*b* after forming a needle foot 53*a* of, for example, about 0.5 to 2 mm, and V-tied, thereby a needle foot 53*a* of a hair is allocated linearly with the length of about 0.5 to 2 mm on the backside of the artificial skin base 52. When one of the hairs is pulled out to the surface side, it is pulled hard utilizing the pulling force of the hooking needle so it does not loosen, and the needle foot 53*a* contacts as if biting in to the backside of the artificial skin base made of soft synthetic resin such as urethane resin. Thus, since the needle foot 53*a* directly contacts to the backside of the artificial skin tightly, it is visible linearly through the ultra thin artificial skin from the surface side of the wig base 52. Then, in the region between hairs where only the skin color of the scalp is visible, the needle foot 53*a* can be seen through as a black line or a spot if the hair is black, so that unnatural appearance different from a human skin (head skin) is given.

Further, if a hair 53 is merely inserted in V shape through an artificial skin base 52, hairs are easily pulled out with a finger or by brushing, so that a hair fixing process is indispensable for firmly fixing the inserted hairs. For the hair fixing, usually adhesive solution diluted with an organic solvent is coated on the backside of a wig base 52 after V-tying, resin coating 54 is formed by attaching said solution on to the artificial skin, thereby coating the resin to be solidified, and a needle foot 53*a* of a hair is sandwiched between the artificial skin base 52 and the resin coating 54 to be fixed and held (Patent References 1 and 2). Thereby, the inserted hair 53 is firmly fixed and held to the artificial skin base 52 without rotating or pulling off.

On the other hand, in case of tying hairs to a conventional net base made mainly of a net member, hairs bent at a central portion are knotted, for example, are tied with a tying needle by knotting to the filament composing a net base, but it is necessary to knot tightly so the hair knot doe not loosen. For the hair tying portions not to loosen, knots are, for example, multiplied, but then the knot is relatively large spherical, and easily visible from the surface side of the net base.

[Patent Reference 1] Japan Patent laid open S52-123755A (1977, Claims)

[Patent Reference 2] Japan Patent 3,484,565

SUMMARY OF THE INVENTION

Problems to be Solved

The conventional V-tying art has such a problem that unnatural color different from scalp color appears on the surface side of an artificial skin base as linear or spotty as the needle foot 53*a* is visible from outside, and this causes deterioration of a wig quality, or exposure of the presence of a wig, resulting in poor appearance. In order to prevent exposure of a needle foot 53*a*, the length of a needle foot 53*a* may be shortened upon tying, but as its limit is at most about 0.4 mm, especially in the region of hair border where the hair is not dense, V-tying art with such a visible needle foot 53*a* is disadvantageous.

The conventional wig using a net base is neither preferable, since its spherical knot portion is easily visible, thereby the presence of the wig is easily recognizable.

The object of the present invention is, in reference to the above-mentioned problems, to provide a wig capable of preventing visibility of a needle foot of a tied hair and a boss-like knot portion from the surface side of a wig base, especially making the hairline looking natural, and giving such appearance as if natural hair grows from the scalp, and a method of manufacturing the same.

Means to Solve Problems

In order to achieve said object, a wig in accordance with the present invention comprising a wig base, and the hair attached thereon, is characterized in that a wig base is composed with a first base member, and a second base member provided to the backside of the first base member, and hairs are provided to the second base member, as well as extend to the surface side of the first base member therethrough.

Hair is preferably bent to two to be a pair of hair by attaching said bent portion to the second base member, and the pair of hair is pulled out through an insertion hole formed in the first base member to extend to the surface side.

Said pair of hair is preferably held in the approximately vertical direction by shrinkage action of the insertion hole of the first base member, and pulled out upward. Also preferably, the backside of the second base member is coated with a hair fixing adhesive, and the attached hair is coated and fixed with the hair fixing adhesive. The first base member is preferably made of an artificial skin. The second base member may preferably be made of a net member, and hairs may be knotted thereto.

According to the above-mentioned makeup, since hairs are attached to the second base member on the backside of the first base member in a wig base, as well as the free end sides of hairs extending from the second base member are pulled out only from the backside to the surface side of the first base member provided to the surface side of the second base member, so the hairs are not directly tied to the first base member, the hair has such appearance as if directly growing, for example, from inside of artificial skin of the first base member. Therefore, a hairline looks natural, and the appearance is markedly improved.

Also, since the portion where hairs are tied on the backside of the first base member is only knotted to the second base member comprising, for example, a net member, the needle foot so far formed by conventional V-tying to an artificial skin member is not formed on the first base member. Since also hairs are not tied to the first base member, a needle foot does not exist, and the portions of hairs knotted to the second base member comprising a net member located beneath are not visible through the first base member. Therefore, even in a sparsely tied region such as a hairline, the presence of a wig is not exposed, and natural appearance is given as if hairs grow from inside of scalp.

Also in case of the first base member made of artificial skin, since hairs are tied to the second base member on the backside of the first artificial skin base member, and held on the surface side of the second base member through insertion holes of the first artificial skin base member, the pulled out hairs are held straight upward by shrinkage action of the insertion holes by the elasticity of artificial skin, resulting in the increased bulky feeling by good hair standing.

Further in accordance with an embodiment of a method of manufacturing a wig of the present invention, it is characterized to include a first step of forming a wig base with a first base member and a second base member provided to its backside, a second step of attaching the hair to the second base member preferably from its backside, and thereafter a third process of pulling out the hairs attached at the second step from the backside to the surface side of the first base member.

Also in accordance with another embodiment of a method of manufacturing a wig of the present invention, it is characterized to include a first step of forming a first and a second base members separately, a second step of attaching hairs to the second base member preferably from its backside, a third step of providing the first base member to the surface side of the second base member, and thereafter a fourth step of pulling out the hairs attached at the second step to the surface side of the first base member.

In case of providing the first base member on the second base member, it may be merely mutual overlapping, mutual adhering after overlapping, or, for example, sewing their peripheries, and may proceed on to the next process of pulling out hairs from the backside to the surface side of the first base member.

According to said method of manufacture, since the hair tied portion is not formed in the first base member but formed in the second base member thereunder, a needle foot is not formed which is formed in case of direct V-tying to a conventional wig using an artificial skin member. Also, since the tied portion is formed only in the second base member of the backside, it is located under the first base member to which it does not contact tightly, so that it is not seen through. Therefore, for hairs tied to a wig base, the spaces among hairs have natural appearance of a human scalp color, even in the sparsely tied region such as a hairline, the appearance as if the hair grows from inside scalp, thereby a wig good in appearance can be manufactured.

In said method of manufacture, in order to pull out hairs tied to the second base member to the surface side of the first base member made of artificial skin, it is preferred to insert a hooking needle from the surface side of the first base member, and to pull out through that insertion hole. It is possible to properly select the pulling out positions of hairs from the first base member by inserting a hooking needle at the desired positions of the surface of the first base member, and to pull out easily hairs from the tied portion to the surface side of the first base member.

Effect of the Invention

The present invention can provide a wig in which a needle foot of the hair tied to a wig base is not formed, neither is the tied portion seen through the first base member, thereby giving natural appearance, its presence not recognized, and having good appearance, and a method of manufacturing the same.

Also according to the present invention, since hairs are attached to the second base member provided under the first wig base (the backside), and then pulled out upward from the first base member of the upper side (surface side), if the first base member is made of artificial skin, the pulled out hairs are held straight upward by shrinkage action by the elasticity of artificial skin of the first base member, resulting in good hair standing, increased bulky feeling, as well as in natural appearance as if the hair grows from inside of scalp.

BEST MODES FOR CARRYING OUT THE INVENTION

Hereinafter, the present invention will be explained in details with reference to the embodiments illustrated in the figures.

Figure 1:
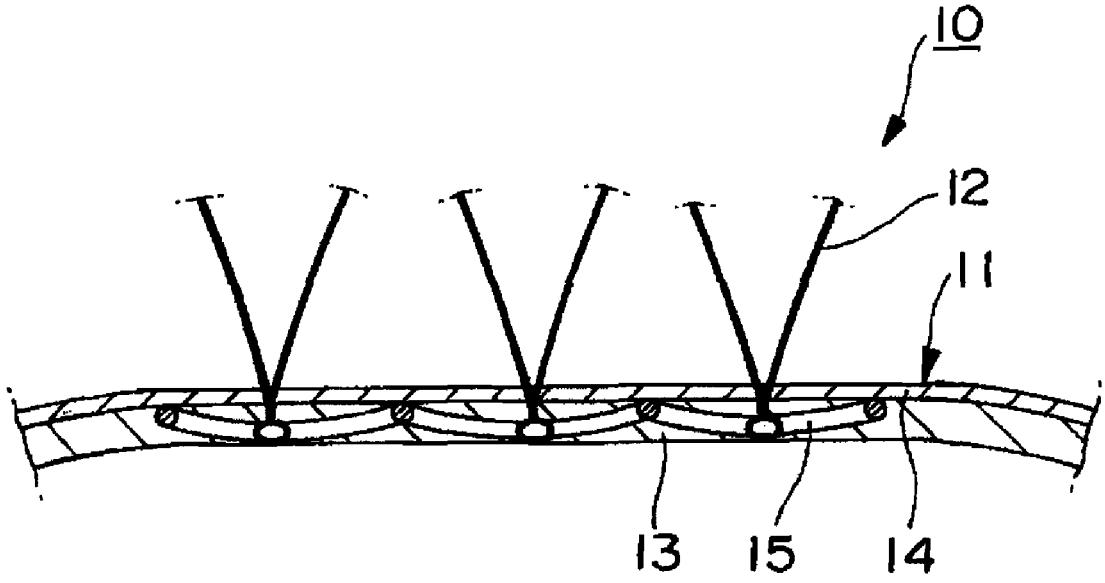
FIG. 1 is a partially enlarged cross sectional view diagrammatically illustrating a makeup of a wig in accordance with the present invention.

Explanation is first made of a wig of the present invention with reference to FIG. 1. FIG. 1 is a partially enlarged cross sectional view diagrammatically illustrating the makeup of a wig in accordance with the present invention. A wig 10 comprises a wig base 11 to be worn to a wearer's head, and hairs 12 attached to the wig base 11 so as to extend to the surface side. The wig base 11 is formed similarly to a head shape selected from those standardized by head size and others, or is formed by molding on a wearer's head shape.

Figure 2:
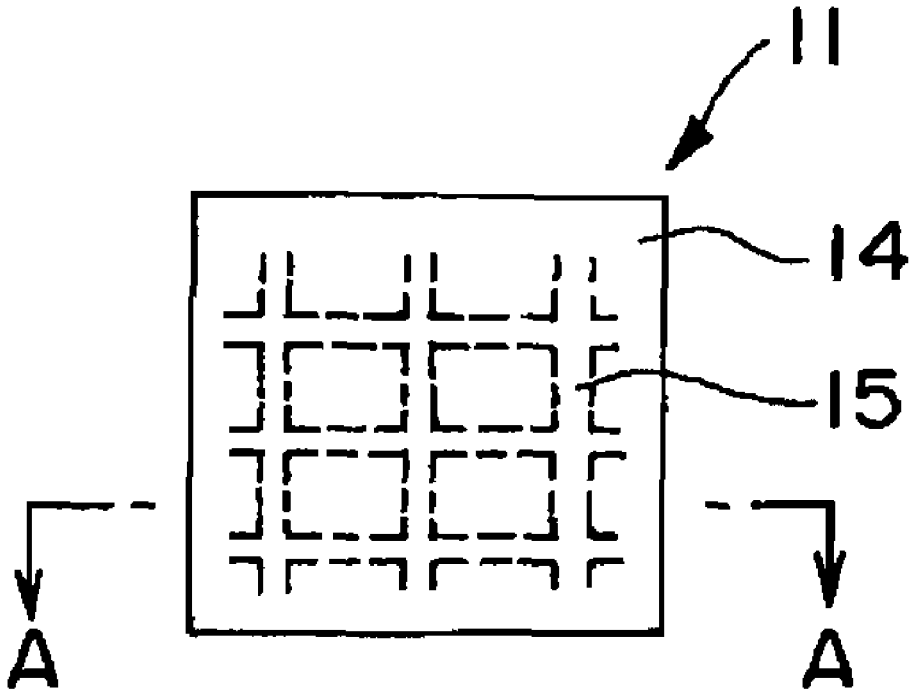
FIG. 2 is a diagrammatical enlarged plan view illustrating a makeup of a wig base used for the wig of FIG. 1.
Figure 3:
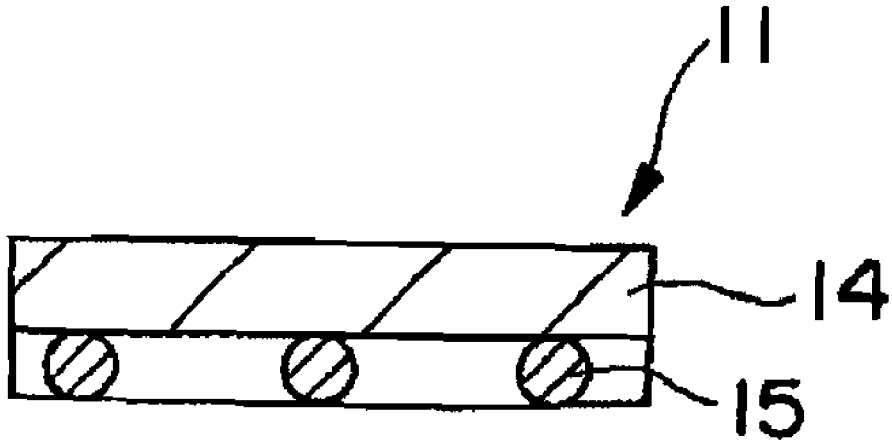
FIG. 3 is a cross sectional view along the line A-A of FIG. 2
Figure 4:
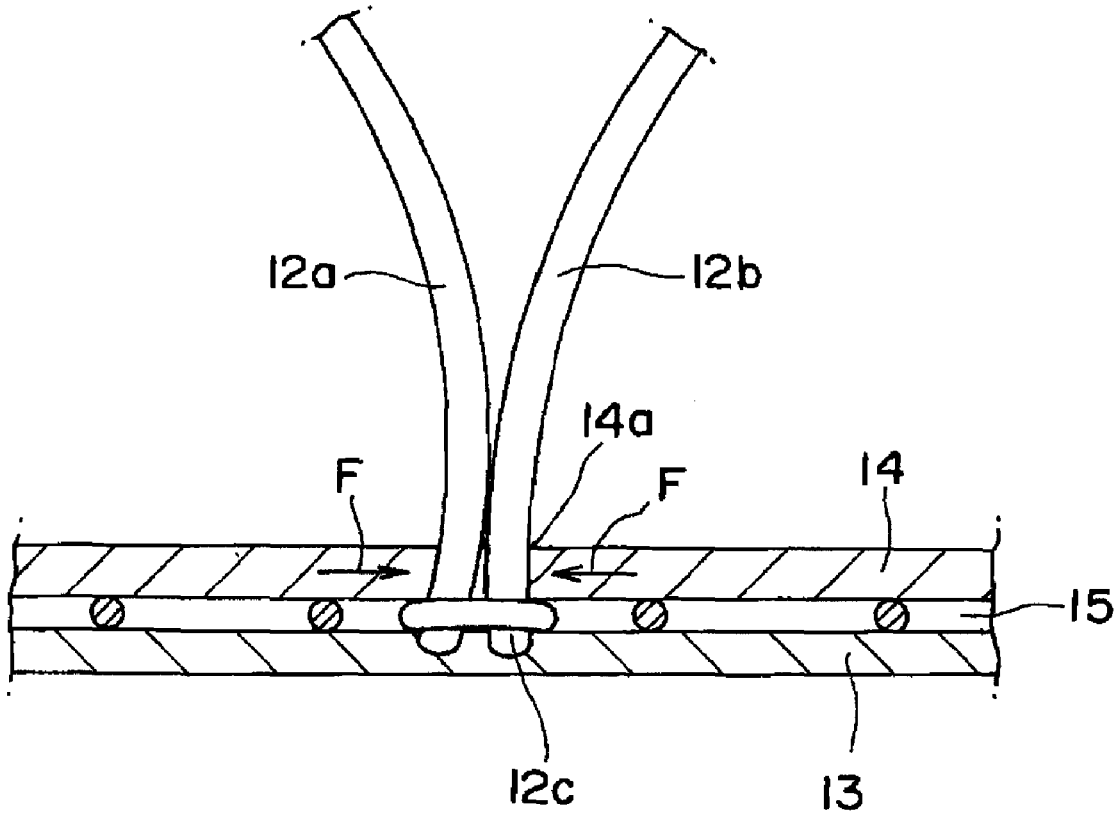
FIG. 4 is a partially enlarged cross sectional view illustrating the state of hair tied to the wig base, and pulled out to the surface.

FIG. 2 is a diagrammatical enlarged plan view illustrating a makeup of a wig base used for the wig of FIG. 1. FIG. 3 is a cross sectional view along the line A-A of FIG. 2. FIG. 4 is a partially enlarged cross sectional view illustrating the state of hair tied to the wig base, and pulled out to the surface.

The wig base 11 comprises, as shown in FIGS. 1-4, a first base member 14, and a second base member 15 provided to the backside (lower side) of the first base member 14, that is, the side contacted to a scalp.

As the first base member 14, a net member may be used, but an artificial skin member resembling human scalp quite closely is preferably used, especially in the present invention. The material of the artificial skin member can be made thin with such soft synthetic resins as, for example, urethane and silicone resins. Since such soft synthetic resins as urethane and silicone resins have elasticity to a certain extent and stretchability, they are good in fit feeling. The first base member 14 of artificial skin is preferably deglossing-processed to eliminate gloss on the surface of the wig 10.

As the second base member 15, an artificial skin member may be used, but a net member is preferably used especially in the present invention. As the material of net members having meshes, nylon monofilaments woven or knitted at predetermined intervals, or those formed by mutually overlapping a warp group having a plurality of nylon monofilaments allocated in the longitudinal direction, and a weft group having a plurality of nylon monofilaments allocated in the direction orthogonal to the warp group, and adhering their cross points may be used. The mesh of the net member 15 may be, for example, 30-60 mesh/inch, and the size (diameter) of filaments composing the net member 15 may be, for example, 80-120 μm (0.08-0.12 mm). As an example, such a thin material as nylon stockings having fine mesh is preferred owing to light weight and good ventilation.

The hair 12 is natural hair or artificial hair made of nylon or polyester, having about same diameter as human hair of about 40-100 μm. The hair 12 is attached on the warp and weft filaments or their cross points of the net member as the second base member 15.

As shown in FIG. 4, tying hairs 12 to the net member is conducted by bending a strand or a few strands to two to form a pair 12*a* and 12*b* of the hair 12, and by hooking their bent portions with a specific hooking needle to form and knot the knots 12*c* in the second base member 15. The pair 12*a* and 12*b* of the tied hairs 12 is penetrated to the first base member 14 of artificial skin provided on the surface side (upper side), and pulled out from the backside to the surface side. FIG. 4 shows the state of the attached pair of hairs 12*a* and 12*b* by using a strand of hair 12, and knotting the bent portion to the second base member 15 by known knotting methods used for knotting strings or others, for example, lark's hitch, clove hitch, left and right knot, or the application thereof.

Thus, the portion of hairs 12 directly contacting to the backside of the first base member 14 is basically the knot portion 12*c* tied to the second base member 15, and if a strand of hair is bent to two, it has only the length of knots for about 2 to 4 strands of hairs. Therefore, for a hair diameter of about 50 μm, the portion of hairs 12 directly contacting the backside of the first base member 14 is at most about 100-400 μm, that is, almost a pin point contact of only about 0.1-0.4 mm. This is only about ⅕ of the needle foot of the conventional wig of about 0.5 to 2 mm, so that it is not visible from outside of the wig 10. In fact, since a pair of hairs 12*a* and 12*b* is located above their knot 12*c*, the knot 12*c* is never seen through from above of the first base member 14.

Here, the net member as the second base member 15 is preferably formed as convex corresponding to the wearer's head shape like the first base member 14, but if the hair 12 is knotted to the second base member 15, either a method of knotting hair 12 from the convex surface side, or from the concave backside may be used. If a former case, hair knots protrude to the surface side, but if a latter case, they are located on the backside.

In case of knotting hair 12 from the backside of the second base member 15, if knots 12*c* contact the scalp to give rough feeling, the hair 12 is pulled out to the surface of the first base member 14, a backcoating agent diluted with organic solvent is coated from the backside of the second base member 15, and the backcoating may be applied to cover knots 12*c* by applying the solution and hardening it on the second and the first base members 15 and 14. The backcoating 13 can coat the second base member 15 together with hair knots 12*c* sandwich-like by being constituted with a material preferably similar to the first base member 14, for example, rubber-elastic synthetic resin solution coated and dried over whole second base member 15.

Hairs 12 tied to the second base member 15 are pulled out to the surface of the first base member 14 as a pair 12*a* and 12*b* as mentioned before. The pulling out work is such that inserting a hooking needle 16 (see FIG. 6) from the artificial skin surface of the first base member 14, hooking a pair of hairs 12*a* and 12*b*, and pulling back the hooking needle 16, thereby pulling out a pair of hairs 12*a* and 12*b* through the insertion hole 14*a* of the artificial skin 14 to which the hooking needle 16 was inserted. Therefore, since a pair of hairs 12*a* and 12*b* are pulled out simultaneously upwards in the approximately vertical direction through one insertion hole 14*a* formed in the artificial skin of the first base member 14, hair knots are not formed on the artificial skin, nor formed is a needle foot on its backside. Thus, natural appearance can be attained as if two strands of hairs grow from a human's skin pore. In this connection, since about two or three strands of human hairs usually grow from one pore, from this point, too, natural appearance is preferably increased.

As shown in FIG. 4, in case to make the first base member 14 with artificial skin which has soft elasticity, since the insertion hole 14*a* shrinks in diameter by said soft elasticity even if the diameter of the insertion hole 14*a* formed with the hooking needle is made more or less larger, the pulled out pair of hairs 12*a* and 12*b* are firmly supported by the shrinkage force F of the insertion hole 14*a*. Therefore, since the pair of hairs 12*a* and 12*b* are held upwards by the shrinkage action of the insertion hole 14*a* of the first base member 14, tied hairs 12 have good standing, and a wig with rich bulky from a small amount of hairs as a whole can be obtained.

Here, if a net member is used as the first base member 14, its meshes are used as insertion holes 14*a*, a hooking needle is inserted through the meshes, and a pair of hairs 12*a* and 12*b* tied to the second base member may be hooked and pulled out upwards. However, since a usual mesh used as an insertion hole 14*a* does not have shrinkage action, standing of the pulled out the hair is not as good as artificial skin.

The wig 10 of the present invention is so made up as described above, in which the wig base 11 is provided, for example, with the first base member 14 made of artificial skin and the second base member 15 made, for example, of a net member on the backside of the first base member 14, constituting a multi-layered structure, and the hair 12 is tied only to the second base member 15, not to the first base member 14, and merely pulled out from the backside to the surface side of the first base member 14. Therefore, in the first base member 14, a needle foot is not formed by tying, and the knots 12*c* of hairs 12 formed in the second base member 15 are located beneath the pulled out hairs 12*a* and 12*b*, so that the knots 12*c* are not seen through from the surface side of the first base member 14.

Thus, since the pair of hairs 12*a* and 12*b* are merely pulled out from the backside to the surface side of the first base member 14, and knots are not formed on the surface of the first base member 14, nor formed is a needle foot on its backside, so the hairs 12 tied to the wig base 11 look as if growing directly from the first base member 14, and natural appearance is attained as if the hair 12 grows from pores. Therefore, the risk is reduced as to the presence of the wig 10 being recognized.

If the first base member 14 is made of soft elastic artificial skin, then the pair of hairs 12*a* and 12*b* pulled out through the insertion hole 14*a* are firmly held by the shrinkage action of the insertion hole 14*a*. Therefore, each hair 12*a* and 12*b* is held standing upwards without lying down at its root, and a wig with rich bulky feeling from a small amount of hair as a whole can be obtained.

Figure 5:
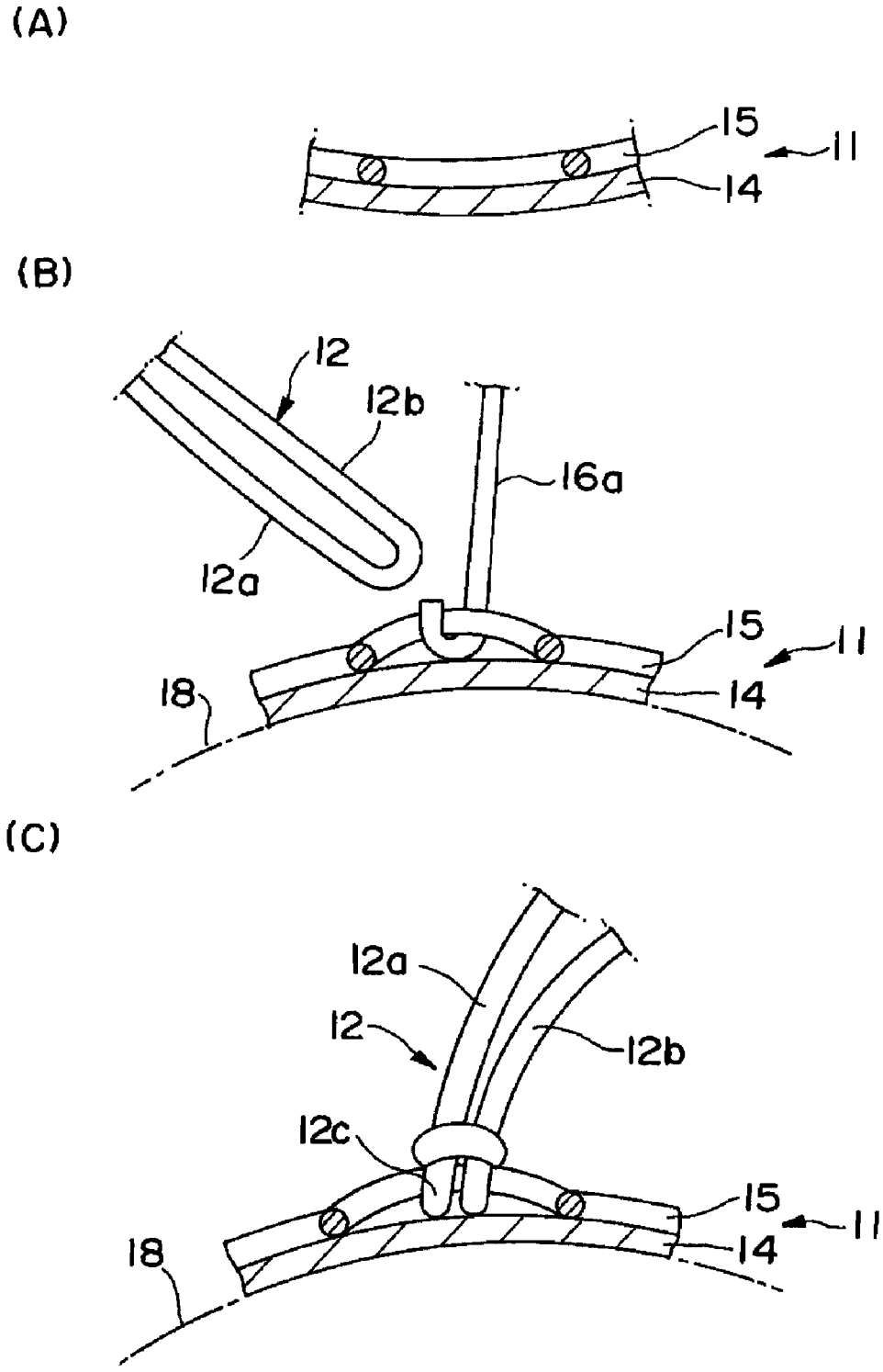
FIG. 5 is a cross sectional view diagrammatically illustrating each sequential step of a method of manufacturing a wig in accordance with a first embodiment of the present invention.
Figure 6:
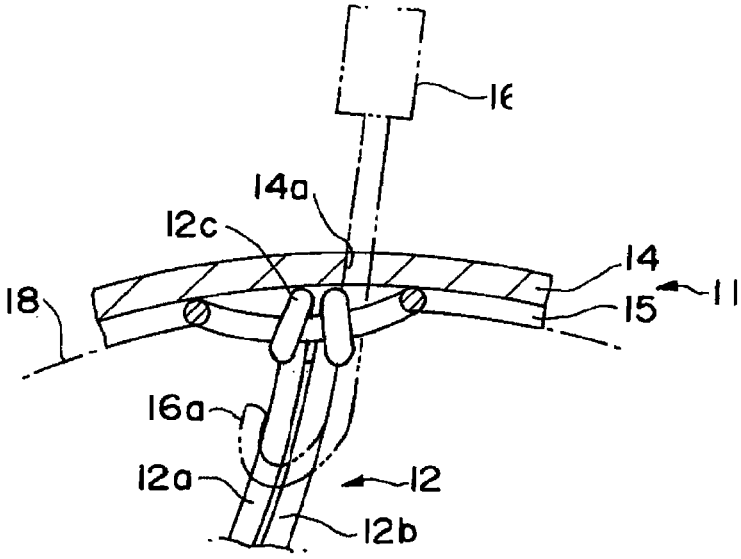
FIG. 6 is a cross sectional view diagrammatically illustrating each sequential step of a method of manufacturing a wig in accordance with a first embodiment of the present invention.
Figure 6:
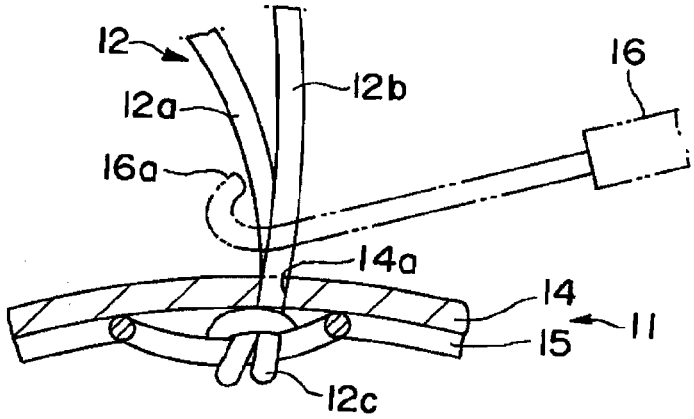
Figure 6:
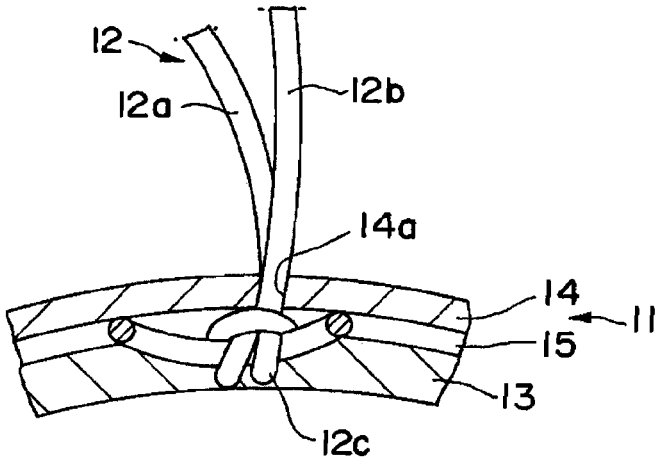
Figure 7:
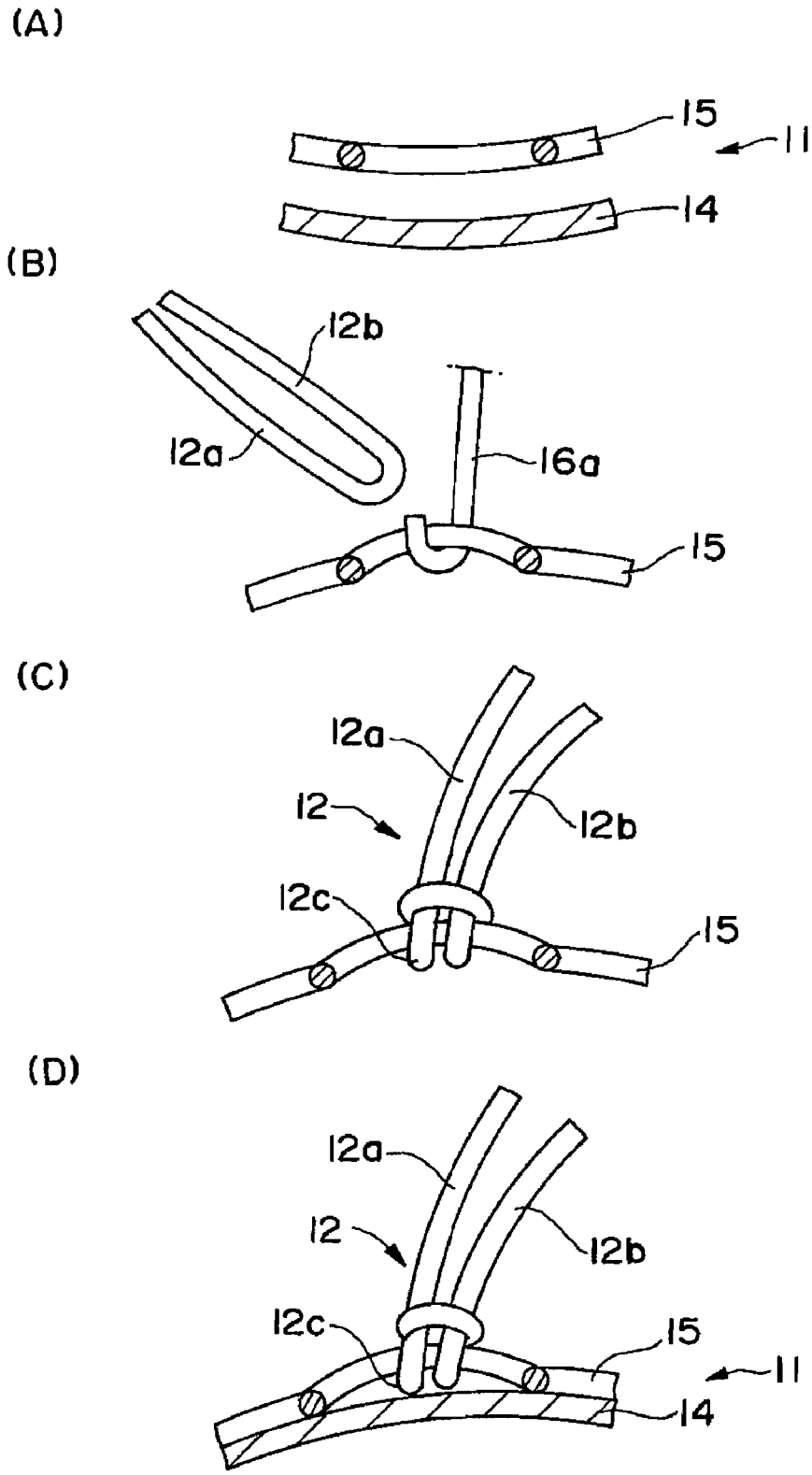
FIG. 7 is a cross sectional view diagrammatically illustrating each sequential step of a method of manufacturing a wig in accordance with a second embodiment of the present invention.
Figure 8:
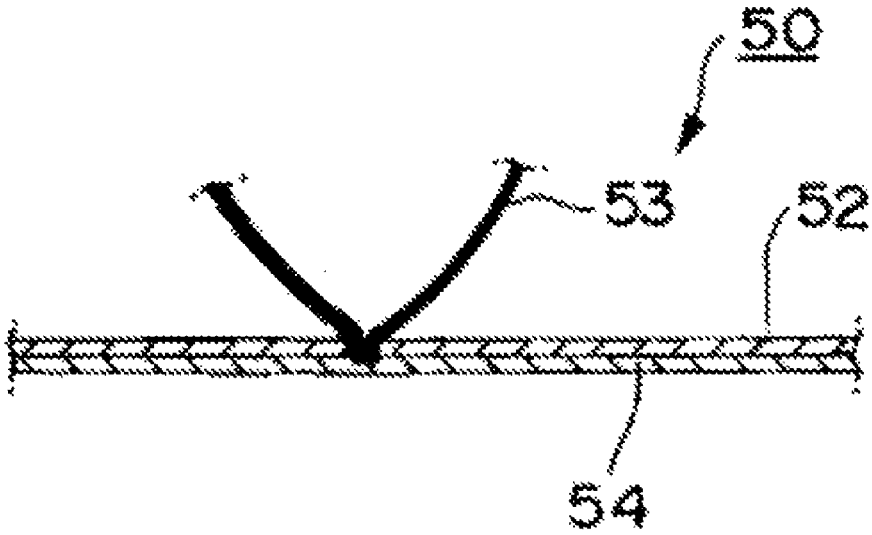
FIG. 8 PRIOR ART
FIG. 8 is a schematic cross sectional view illustrating an exemplary makeup of a conventional wig.
Figure 9:
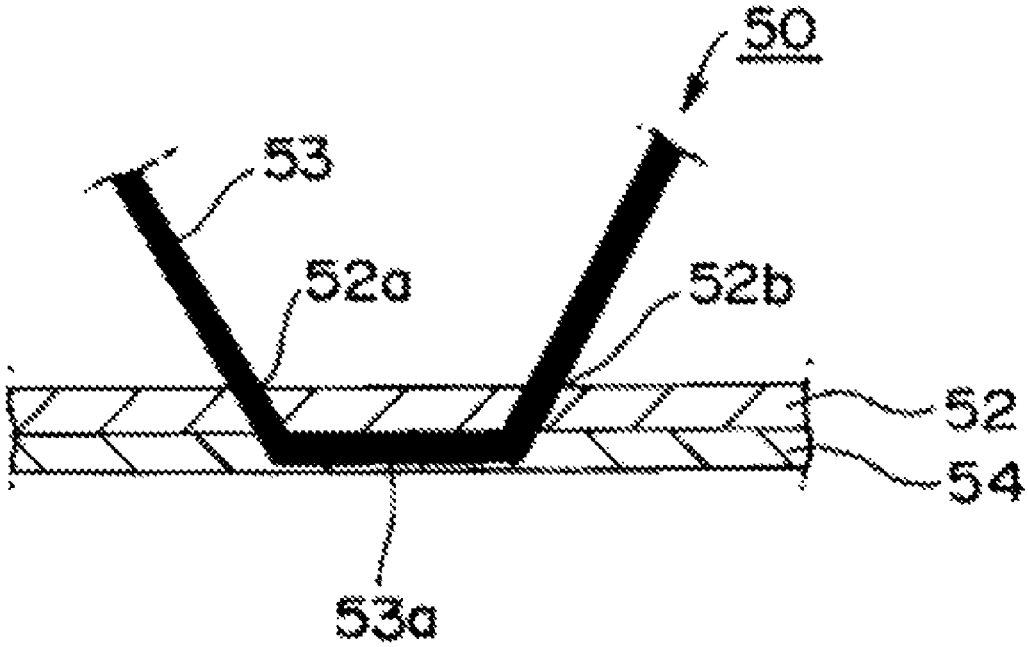
FIG. 9 PRIOR ART
FIG. 9 is an enlarged cross sectional view illustrating an example of a method of tying for a wig of FIG. 8.

Next, explanation is made of a method of manufacturing a wig in accordance with the present invention, referring to FIGS. 5 to 7.

FIG. 5 is a sectional view sequentially illustrating each step of a method of manufacturing a wig in accordance with a first embodiment of the present invention. As a first step shown in FIG. 5(A), the net member 15 as the second base member is provided to the artificial skin member 14 as the first base member, and the wig base 11 comprising the artificial skin member 14 and the net member 15 provided on its backside is formed. The net member 15 may be fixed to the artificial skin member 14 by, for example, after each of them is formed, disposing the net member 15 to the predetermined position of the backside of the artificial skin member 14, and by thinly coating an adhesive over a whole range for tentative adhesion of the net member 15, or by laminating them, and adopting proper means such as thermal spot welding or sewing around or at proper positions.

The artificial skin member 14 and the net member 15 can be made as head shape-like selected from the normalized ones according to a head size or others, or by molding to fit to the wearer's head shape. Since the net member 15 is disposed along the concavity of the backside of the artificial skin member 14, the net member 15 is preferably formed to have a convex surface fitting to the curvature of the artificial skin member 14.

Next, as a second step shown in FIG. 5(B), the hair 12 is attached to the backside of the wig base 11, namely, the concave backside of the net member 15. Tying work is conducted, for example, with the inverted state of back and surface sides of the wig base 11, namely, by holding the backside up of the net member 15 to a male mold 18 of a head shape.

When hairs are tied to the artificial skin member 14 and the net member 15 tentatively fixed together with an adhesive as described above, by hooking the filaments making up the net member 15 with a hook portion 16*a* of the hooking needle 16, and lifting up a little, the net member 15 is partly peeled off from the artificial skin member 14 in the region around the tentatively fixed part, as adhesion is made weak. Thereafter, to the part of the net member 15 raised from the artificial skin member 14 and slightly peeled off, as shown in FIG. 5(C), the parts of hair 12 are tied using the hooking needle 16 by a known knotting method to be used to knot a string or the like, such as lark's hitch, clove hitch, left and right knot, and the application thereof. For example, after the bent portion of hair 12 is hooked with the hook portion 16*a*, and wound around the filament of the net member 15, a pair of hairs 12*a* and 12*b* are inserted into a loop of the bent portion and pulled out, resulting in formation of a knot 12*c* as illustrated. It may be further knotted a few more times thereafter so not to loosen. Thus, tying work is conducted with a predetermined hair amount over a whole range of the net member 15.

After the tying work to the net member 15 is completed, as a third step shown in FIG. 6(D), the wig base 11 is again inverted, and held on a male mold 18 of a head shape so to have the artificial skin member 14 to an upper side. In this state, the net member 15 is disposed beneath the artificial skin member 14, and the hair 12 tied to the net member 15 are held between the net member 15 and the male mold. Thus held, the hooking needle 16 is inserted at a predetermined position 14*a* of the artificial skin member 14 from the surface of the artificial skin member 14 above.

The insertion hole 14*a* is formed with the hooking needle 16 inserted through the artificial skin member 14, and by hooking two strands (a pair) of hairs 12*a* and 12*b* of hairs 12, with the hook portion 16*a* at a tip, and pulling out the hooking needle 16 through the insertion hole 14*a*, the pair of hairs 12*a* and 12*b* are pulled out to the surface of the artificial skin member 14, as shown in FIG. 6(E). Since the pulled out pair of hairs 12*a* and 12*b* are firmly held by the shrinkage action of the insertion hole 14*a* of a soft elastic artificial skin member 14, hairs stand and extend upward from roots.

Thus, hairs 12 are tied to the wig base 11, and by repeating the above-mentioned steps, numerous hairs 12 are tied to the wig base 11. Here in the above-mentioned steps, properly dividing (several times, for example) the whole amount to be tied, tying the predetermined hair amount to the net member, and pulling out to the surface side of the artificial skin member 14, and said operation may be repeated.

After whole hair 12 of the predetermined amount are tied to the wig base 11, as a fourth step if necessary, backcoating 13 may be applied as shown in FIG. 6(F). In this case, after completion of the third step, the solution for hair fixing diluted with an organic solvent is coated over the net member 15, and backcoating 13 is applied over the knot 12*c* by accreting and solidifying the solution to the net member 15 and the artificial skin member 14. The solution for hair fixing can coat the net member 15 together with the hair knot 12*c* as sandwich-like by being composed with, for example, rubber-elastic synthetic resin solution, preferably a material similar to the artificial skin member 14. Thereby, since the knots 12*c* of the tied hair 12 are completely coated with the backcoating 13 and fixed, said knots 12*c* do not contact the scalp to give rough feeling, so it can be worn on head skin with good fit feeling.

Explanation is next made of a method of manufacturing a wig in accordance with the second embodiment of the present invention, referring to FIG. 7. In FIG. 7(A), the step of making the artificial member 14 as the first base member and the net member 15 as the second base member separately is same as the first step of the first embodiment.

In the present embodiment as shown in FIGS. 7(B) and (C), the hair 12 is tied to the net member 15 as a second step, prior to overlapping the net member 15 to the artificial skin member 14. In this case, the tied hair may be so tied as to extend to the surface side of the net member 15, that is, to the convex surface side, or to the backside, that is, to the concave backside. FIG. 7(B) shows an example of tying to extend to the concave backside. Here, tying work to the net member 15 is same as in the first embodiment, and explanation is omitted.

Next, as a third step as shown in FIG. 7(D), the convex surface side of the net member 15 with the hair 12 tied thereon is disposed closely to the concave inner side of the artificial skin member 14 and fixed. For example, an adhesive is applied over a whole concave inner side or a periphery of the artificial skin member 14, and the convex surface side of the net member 15 may be positioned properly and adhered, or the periphery may be tentatively fixed with sewing thread or else after properly positioned. Or, after holding and properly positioning the net member 15 and the artificial skin member 14 in turn on the male mold 18, they may be held by pinning or their periphery may be held with tape or else.

Thus, as a fourth step after holding on the male mold 18, like the first embodiment, the hooking needle 16 is inserted from the surface of the artificial skin member 14, the pair of hairs 12*a* and 12*b* are hooked with the hook portion 16*a* at its tip, and the hooking needle 16 is pulled out through the insertion hole 14*a* of the artificial skin member 14, and then each of hairs 12*a* and 12*b* is pulled out to the surface side of the artificial skin member 14. Since a series of these works are same as in FIGS. 6(D) and (E) used in explanation of the first embodiment, illustration is omitted.

The pulled out pair of hairs 12*a* and 12*b* are firmly held by the shrinkage action of the insertion hole 14*a* of the artificial skin member 14, and stand and extend upward from roots, as in the case of the above-mentioned first embodiment.

Thus, the hair 12*a* is tied to the wig base 11, and via the above-mentioned steps, numerous hairs 12 are tied to the wig base 11.

After whole hair 12 of the predetermined amount is tied to the wig base 11, as a fifth step if necessary, by applying backcoating 13 to cover knots 12*c* over the net member 15 as in FIG. 6(F) of the first embodiment, the knots 12*c* of hairs 12 are completely covered and fixed, thereby the wig can be worn on head skin with good fit feeling.

In the above-mentioned method of manufacture, the second base member 15 is specifically explained as a net member, but the second base member 15 may be an artificial skin member.

Example

As an Example, a wig 10 in accordance with the present invention was manufactured by a method of manufacture in accordance with the first embodiment of the present invention.

Utilizing a male mold of the wearer's head shape prepared in advance, a first base member 14 was manufactured from an artificial skin member convexly curved along the wearer's head shape by applying, drying, and molding a urethane resin as a thermoplastic resin to a predetermined thickness. Also separately, after covering the above-mentioned male mold of a head shape with a net and applying a solution of a thermosetting urethane resin diluted with an organic solvent, a net member 15 was manufactured as the second base member by heating at about 100° C., and shaping as curved to the head shape.

Next, the artificial skin member 14 was inverted, and adhered to said male mold, and on said artificial skin member 14, an inverted net member 15 was covered likewise. An organic solvent was applied to the artificial skin member 14, dried for a certain time at a certain temperature, and the net member 15 was tentatively fixed to the artificial skin member 14, thereby a wig base 11 was manufactured. In this case, for easy tying, the organic solvent was thinly applied to be unified so the net member 15 was not buried totally in the artificial skin member 14.

As a second step, hairs 12 were tied to the net member 15 with the above-mentioned male mold, and the artificial skin member 14, and the net member 15 covered and held thereon (see FIGS. 5(B) and (C)). Tying was conducted by bending to two at a center portion of artificial hairs made of 30 cm long nylon filaments, hooking the bent portion to a tying needle, and by winding to the filaments constituting the net member 15 to form knots 12*c*, forming a pair of hairs 12*a* and 12*b* of about 15 cm of length, and said tying work was repeated till reaching a predetermined hair amount.

As a third step after hair tying, the wig base 11 was taken off from the male mold, inverted so that the artificial skin member 14 came as the uppermost layer, and put again on the male mold 18. That is, held on a male mold were hairs, a net member 15, and an artificial skin member 14 arranged in turn, a hooking needle 16 was inserted from the surface side of the artificial skin member 14 by making an insertion hole 14*a* in the artificial skin member 14, a pair of hairs 12*a* and 12*b* of the hairs 12 were hooked with a hook portion 16*a* at the tip, and, as shown in FIG. 6(E), the free end side of the hair was taken back through the insertion hole 14*a*, and pulled out to the surface side of the artificial skin member 14 (See FIGS. 6(D) and (E)). Thus, by pulling out all the tied hair 12 to the surface side of the artificial skin member 14, a wig 10 was manufactured.

Comparative Example

A conventional wig having only an artificial skin member 14, not a net member 15 as a wig base was manufactured using the same hair and hair amount as in Example 1 and V-type tying.

Next, outside appearance inspection was conducted for Example and Comparative Example.

In case of a wig of Example, hairs were tied only to the net member provided to the backside of artificial skin, but not to the artificial skin member, so that it looked as if two strands of hairs grown from scalp grew from a single pore. No needle foot portion existed as not tied by V-tying, a linear needle foot portion was not seen through as in the case of Comparative Example, thereby it had good natural feeling especially at a hairline to give excellent appearance compared with Comparative Example.

Suitable forms of embodiment of the present invention have been explained above, but the present invention is in no way limited only to the forms of embodiment, but appropriate variations are possible within the range of the present invention. Further, the concrete numerical values and the like explained in said embodiment can be appropriately modified as is necessary.

What is claimed is:

1. A method of manufacturing a wig, comprising:

a first step of making a wig base by coupling a first base member made of soft elastic artificial skin and a second base member made of a net member on the backside thereof, a second step of reversing said wig base to the back side and tying a bent portion of a pair of hair formed by bending a strand or a number of strands of hair to the back side of said second base member so as to form a hair knot on the back side of said second base member, and a third step of reversing the once reversed wig base again after hair tying, forming an insertion hole in said first base member by inserting a hook needle from the surface of said first base member disposed on the upper surface, and pulling out simultaneously the pair of hair to the surface side of said first base member through said insertion hole by inserting said hook needle to the back side of the second base member and hooking said pair of hair, wherein both tip sides of said pair of hair are pinched at said first base member and held upward by shrinkage of said insertion hole of said first base member.

2. A method of manufacturing a wig, comprising:

a first step of making separately a first base member made of soft elastic artificial skin and a second base member made of a net member to be provided to the backside thereof, a second step of reversing said second base member and tying a bent portion of a pair of hair formed by bending a strand or a number of strands of hair to the back side of said second base member so as to form a hair knot on the back side of said second base member, a third step of reversing said second base member again on which hair is tied to the surface side, and providing said first base member on said second base member, and a fourth step of forming an insertion hole in said first base member by inserting a hook needle from the surface of said first base member thereafter, and pulling out simultaneously the pair of hair to the surface side of said first base member through said insertion hole by inserting said hook needle to the back side of the second base member and hooking said pair of hair, wherein both tip sides of said pair of hair are pinched at said first base member and held upward by shrinkage of said insertion hole of said first base member.

3. The method of manufacturing a wig as set forth in claim 1 or 2, wherein an adhesive for hair fixing is further applied on the backside of said second base member, and the attached hair is covered and fixed with said adhesive for hair fixing.

4. The method of manufacturing a wig as set forth in claim 1 or 2, wherein said second base member is disposed by adhesion or sewing to the backside of the first base member.

5. The method of manufacturing a wig as set forth in claim 1 or 2, wherein for adhesion of said second base member to said first base member, tentative adhesion is applied by coating adhesive solution thinly.

* * * * *